US009813794B2

(12) United States Patent
Cheng et al.

(10) Patent No.: US 9,813,794 B2
(45) **Date of Patent: *Nov. 7, 2017**

(54) NOISE REDUCTION WITH IN-EAR HEADPHONE

(71) Applicant: Bose Corporation, Framingham, MA (US)

(72) Inventors: Lei Cheng, Wellesley, MA (US); Ellen I. Searl, Charlton, MA (US); Joseph Jankovsky, Holliston, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/430,076

(22) Filed: Feb. 10, 2017

(65) Prior Publication Data

US 2017/0155994 A1 Jun. 1, 2017

Related U.S. Application Data

(63) Continuation of application No. 14/818,639, filed on Aug. 5, 2015.

(51) Int. Cl.

| | |
|---|---|
| ***H04R 25/00*** | (2006.01) |
| ***H04R 1/10*** | (2006.01) |
| ***H04R 1/02*** | (2006.01) |

(52) U.S. Cl.

CPC ..... *H04R 1/1016* (2013.01); *H04R 1/023* (2013.01); *H04R 1/105* (2013.01); *H04R 1/1058* (2013.01); *H04R 2460/01* (2013.01)

(58) Field of Classification Search

CPC ..... H04R 1/02; H04R 1/1016; H04R 1/1083; H04R 1/1091; H04R 9/06

(Continued)

(56) References Cited

U.S. PATENT DOCUMENTS 4,644,581 A 2/1987 Sapiejewski
4,736,435 A * 4/1988 Yokoyama ..... H04R 9/10 381/322

(Continued)

FOREIGN PATENT DOCUMENTS

| | | |
|---|---|---|
| EP | 2280557 A1 | 2/2011 |
| WO | 0143500 A1 | 6/2001 |
| WO | 2011061483 A2 | 5/2011 |

OTHER PUBLICATIONS

International Search Report & Written Opinion in counterpart International Patent Application No. PCT/US16/44169, dated Nov. 7, 2016; 12 pages.

(Continued)

*Primary Examiner* — Brian Ensey
(74) *Attorney, Agent, or Firm* — Schmeiser, Olsen & Watts LLP

(57) ABSTRACT

An in-ear headphone comprises an earbud body constructed and arranged for positioning in an ear canal of a wearer, and configured to have a distal end farther into the ear canal than a proximal end. The earbud body includes a cavity and an opening to the cavity. The in-ear headphone further comprises a transducer in the opening to the cavity, a portion of the transducer facing outward from the opening; a microphone at the distal end of the earbud body; an earbud tip on the earbud body and complying with a surface of the earbud body; and an acoustically resistive mesh structure at a distal end of the earbud tip. The mesh structure covers the microphone and the portion of the transducer facing outward from the opening.

20 Claims, 5 Drawing Sheets

(58) Field of Classification Search
USPC ..... 381/328, 380
See application file for complete search history.

(56) References Cited

U.S. PATENT DOCUMENTS

| | | | | |
|---|---|---|---|---|
| 8,047,207 | B2 | 11/2011 | Perez et al. | |
| 8,428,289 | B2 | 4/2013 | Wengreen | |
| 8,774,434 | B2 * | 7/2014 | Zhao | H04R 25/656 381/328 |
| 2009/0080670 | A1 | 3/2009 | Solbeck et al. | |
| 2010/0177904 | A1 | 7/2010 | Sung et al. | |
| 2012/0039500 | A1 * | 2/2012 | Silvestri | H04R 1/1016 381/380 |
| 2014/0211970 | A1 | 7/2014 | Sibbald et al. | |
| 2014/0369545 | A1 | 12/2014 | Fukushima et al. | |
| 2015/0055810 | A1 * | 2/2015 | Shin | H04R 1/1083 381/332 |
| 2015/0092977 | A1 | 4/2015 | Silvestri et al. | |
| 2017/0006371 | A1 | 1/2017 | Lam | |

OTHER PUBLICATIONS

Non-Final Office Action in related U.S. Appl. No. 14/818,639, dated Sep. 22, 2016; 12 pages.
Notice of Allowance in related U.S. Appl. No. 14/818,639, dated Jan. 11, 2017; 8 pages.
Non-Final Office Action in related U.S. Appl. No. 15/457,508, dated May 2, 2017; 11 pages.
Notice of Allowance in related U.S. Appl. No. 15/457,508, dated Jun. 2, 2017; 8 pages.

* cited by examiner

NOISE REDUCTION WITH IN-EAR HEADPHONE

PRIORITY CLAIM AND CROSS-REFERENCE

This application is a continuation of, and claims priority to, U.S. patent application Ser. No. 14/818,639, filed Aug. 5, 2015, now U.S. Pat. No. 9,635,452, the entire contents of which is incorporated herein by reference.

BACKGROUND

The present disclosure relates generally to audio devices, and more specifically, to in-ear earbud systems and methods.

BRIEF SUMMARY

In a general aspect, provided is an in-ear headphone, comprising: an earbud body constructed and arranged for positioning in an ear canal of a wearer, and configured to have a distal end farther into the ear canal than a proximal end. The earbud body includes a cavity and an opening to the cavity. The in-ear headphone further comprises a transducer in the opening to the cavity, a portion of the transducer facing outward from the opening; a microphone at the distal end of the earbud body; an earbud tip on the earbud body and complying with a surface of the earbud body; and an acoustically resistive mesh structure at a distal end of the earbud tip. The mesh structure covers the microphone and the portion of the transducer facing outward from the opening.

Aspects may include one or more of the following features:

The transducer may be a moving coil transducer.

The in-ear headphone of claim 1 may further comprises a retaining loop coupled to the proximal end of the earbud body.

The earbud body may have a conical shape.

The cavity may have a conical shape including a first end and a second end wider than the first end, and the opening to the cavity may have a cylindrical shape extending from the distal end of the earbud body to the first end of the cavity.

The earbud body may include a bend for accommodating a bend in the ear canal.

The earbud body may have a first portion and a second portion. The cavity may be at the first portion. The opening to the cavity may be at the second portion. The first portion and the cavity may extend in a first direction of extension. The second portion and the opening to the cavity may diverge from the first direction of extension in a second direction of extension at an angle relative to the first direction of extension. The bend may be at a region of the earbud body between the first portion and the second portion where the second portion and the opening to the cavity diverges from the first direction of extension.

The earbud tip may have a first portion and a second portion, the first portion of the earbud tip on the first portion of the earbud body, the second portion of the earbud tip on the second portion of the earbud body. The first portion of the earbud tip may extend in the first direction of extension, the second portion of the earbud tip may extend in the second direction of extension at an angle relative to the first direction of extension. The earbud tip may include a bend at a region of the earbud tip between the first portion of the earbud tip and the second portion of the earbud tip.

The cavity may be a sealed back cavity.

The earbud tip may include a coupling mechanism that engages with a coupling mechanism at the surface of the earbud body to secure the earbud tip against the earbud body.

In another general aspect, an in-ear headphone comprises a cone-shaped earbud body constructed and arranged for positioning in an ear canal of a wearer. The earbud body includes a cavity having a first end and a second end wider than the first end. The first end includes an opening to the cavity. A region of the earbud body includes a bend for accommodating a contour in the ear canal. A flexible earbud tip is attached to and about at least a portion of the earbud body and about the opening to the cavity. The earbud tip is constructed and arranged for positioning over the bend in the earbud body.

Aspects may include one or more of the following features:

The in-ear headphone may comprise a microphone at the opening to the cavity of the earbud body.

The in-ear headphone may comprise an acoustically resistive mesh structure covering the opening to the cavity, and positioned over the microphone.

The second end of the cavity may include a sealed back.

The in-ear headphone may comprise a transducer in the cavity of the earbud body, the transducer proximal to the microphone.

The in-ear headphone may comprise a retaining loop coupled to the second end of the earbud body.

The earbud body may have a first portion and a second portion, the cavity may be at the first portion, the opening to the cavity may be at the second portion, the first portion and the cavity may extend in a first direction of extension, the second portion and the opening to the cavity may diverge from the first direction of extension in a second direction of extension at an angle relative to the first direction of extension, and the bend may be at a region of the earbud body between the first portion and the second portion where the second portion and the opening to the cavity diverges from the first direction of extension.

The earbud tip may have a first portion and a second portion, the first portion of the earbud tip on the first portion of the earbud body, the second portion of the earbud tip on the second portion of the earbud body, the first portion of the earbud tip extending in the first direction of extension, the second portion of the earbud tip extending in the second direction of extension at an angle relative to the first direction of extension, and the earbud tip including a bend at a region of the earbud tip between the first portion of the earbud tip and the second portion of the earbud tip.

In another general aspect, an in-ear headphone comprises an earbud body constructed and arranged for positioning at an ear canal of an ear of a wearer, the earbud body including a cavity having a first end including an opening to the cavity and a second end having a sealed back; a transducer in the cavity; a microphone at the opening, the microphone proximal the transducer; and a flexible earbud tip attached to and about at least a portion of the earbud body and about the opening to the cavity.

The microphone and transducer may extend from the first end of the cavity at the first end.

BRIEF DESCRIPTION OF DRAWINGS

The above and further advantages may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

What is disclosed and what is claimed herein is intended to be applicable to a wide variety of personal audio devices, i.e., devices that are structured to be at least partly worn by a user in the vicinity of at least one of the user's ears to provide, in some embodiments, noise reduction functionality for at least that ear. It should be noted that although various specific implementations of audio devices, such as headphones, two-way communications headsets, earphones, earbuds, wireless headsets (also known as "earsets") and ear protectors are presented with some degree of detail, such presentations of specific implementations are intended to facilitate understanding through the use of examples, and should not be taken as limiting either the scope of disclosure or the scope of claim coverage.

A conventional earphone, when worn, typically includes an earbud positioned partially inside the ear canal. However, deep insertion of a conventional earbud may result in irritation of the ear canal. Also, components of the earbud, in particular, the microphone (if one is present) and audio output transducer (i.e., speaker), are often near the opening of the earbud facing the eardrum, and are prone to damage caused by dust or other undesirable matter when these components are exposed in the ear canal. On the other hand, it is important that a direct uninterrupted path exist between the eardrum and the sound source for improved active noise reduction (ANR) performance.

It is therefore desirable for the microphone and transducer of an earbud to be protected when inserted in the ear, and for the earbud and its components, namely, the microphone and transducer, to be constructed and arranged to be as close to the eardrum as possible while isolating the ear canal from surrounding environmental noise.

Figure 1A:
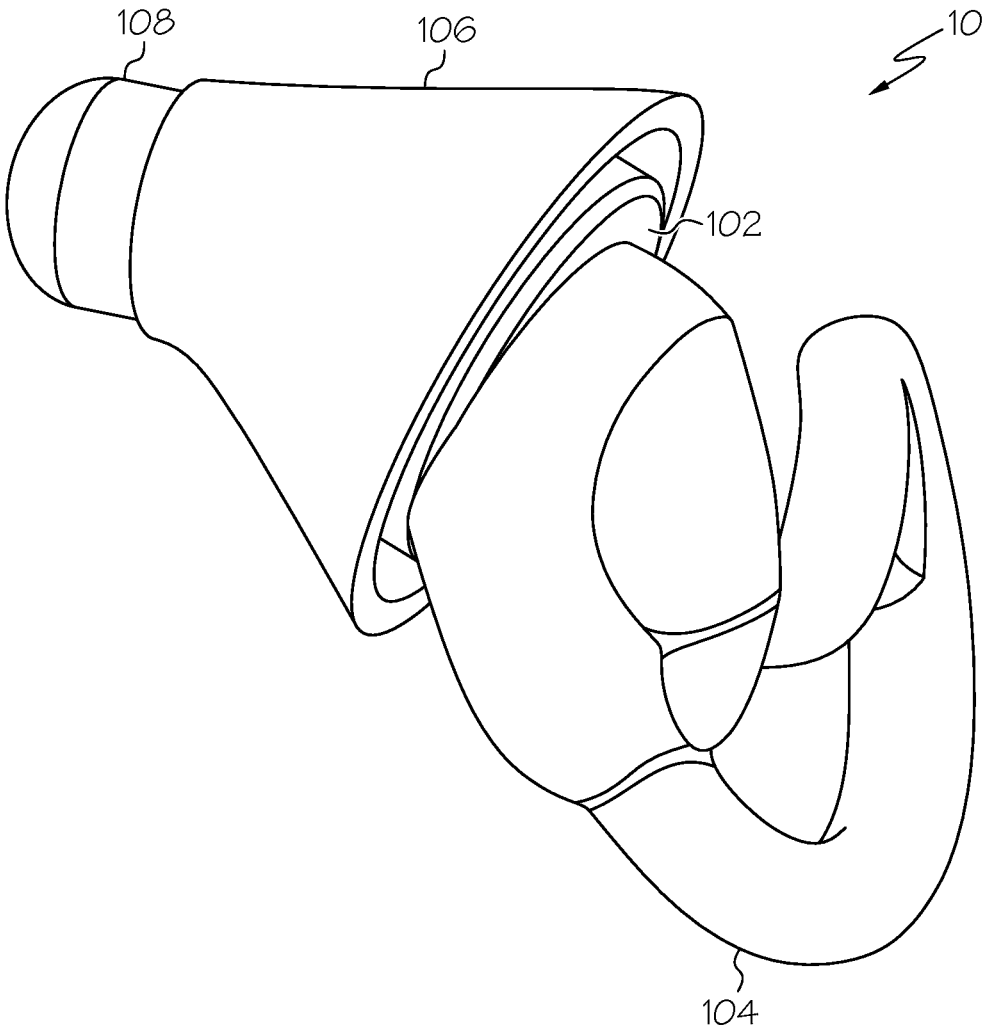
FIG. 1A is a perspective view of an in-ear headphone, in accordance with some examples.
Figure 1B:
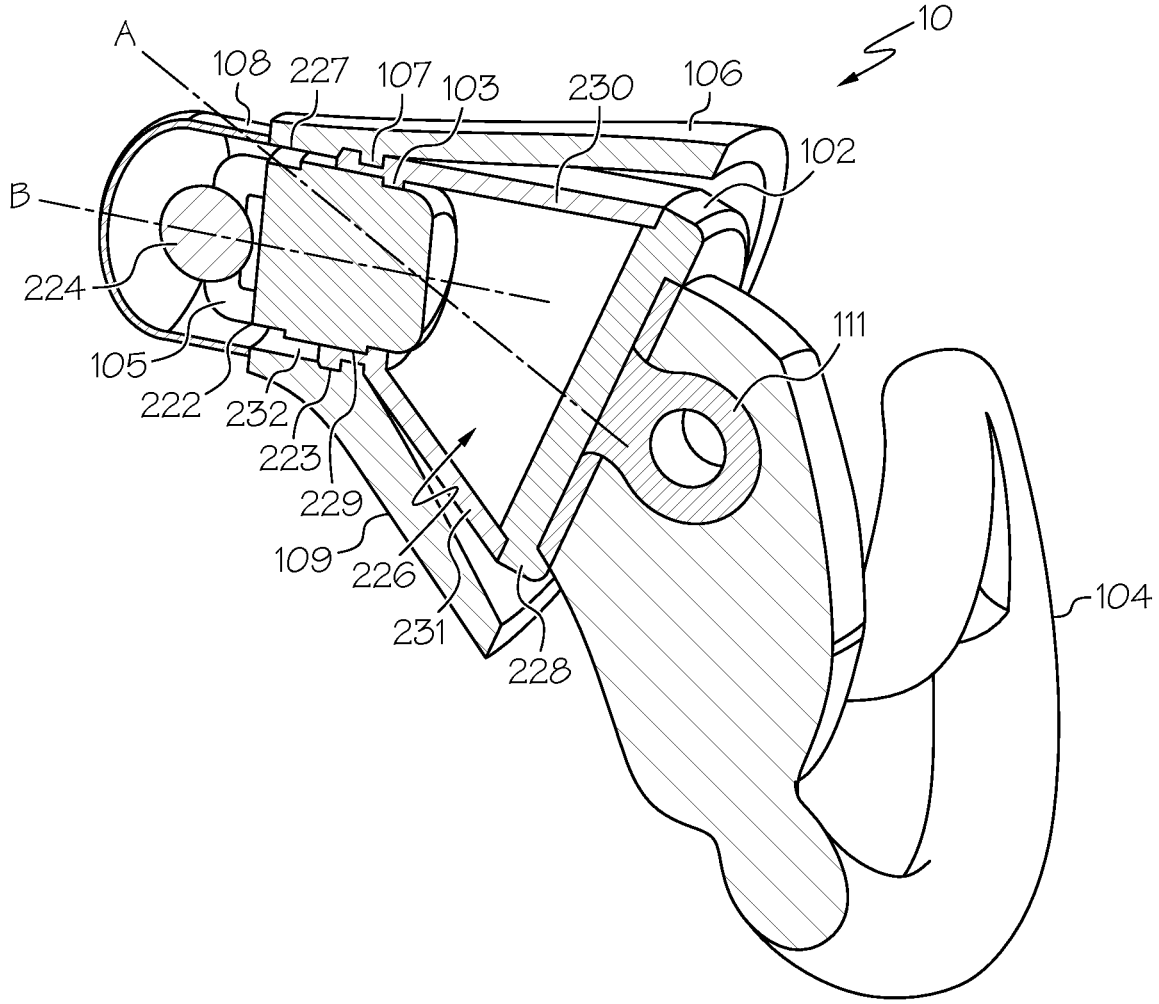
FIG. 1B is a cutaway view of the in-ear headphone of FIG. 1A illustrating an interior of the in-ear headphone.
Figure 2:
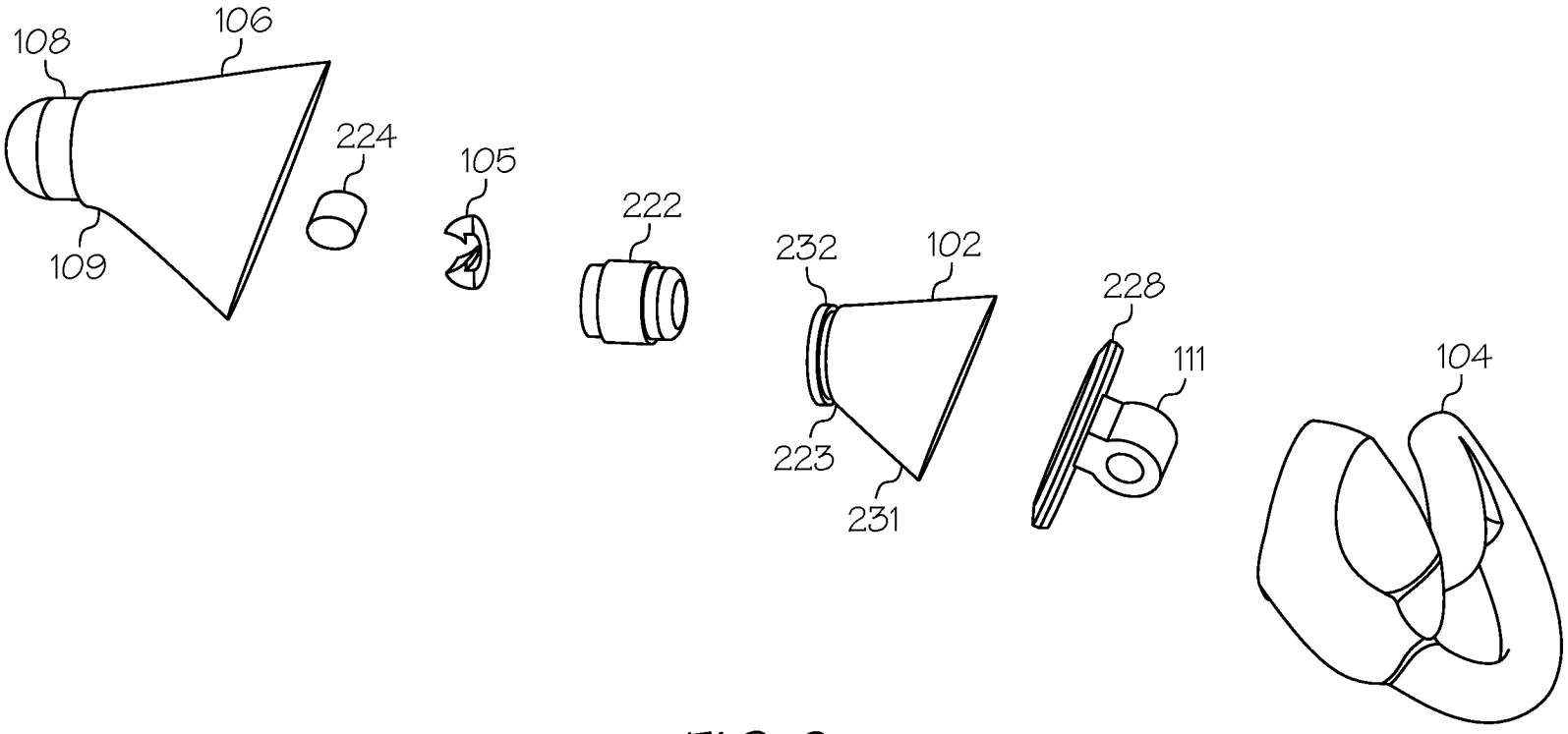
FIG. 2 is an exploded view of the in-ear headphone of FIGS. 1A and 1B.
Figure 3:
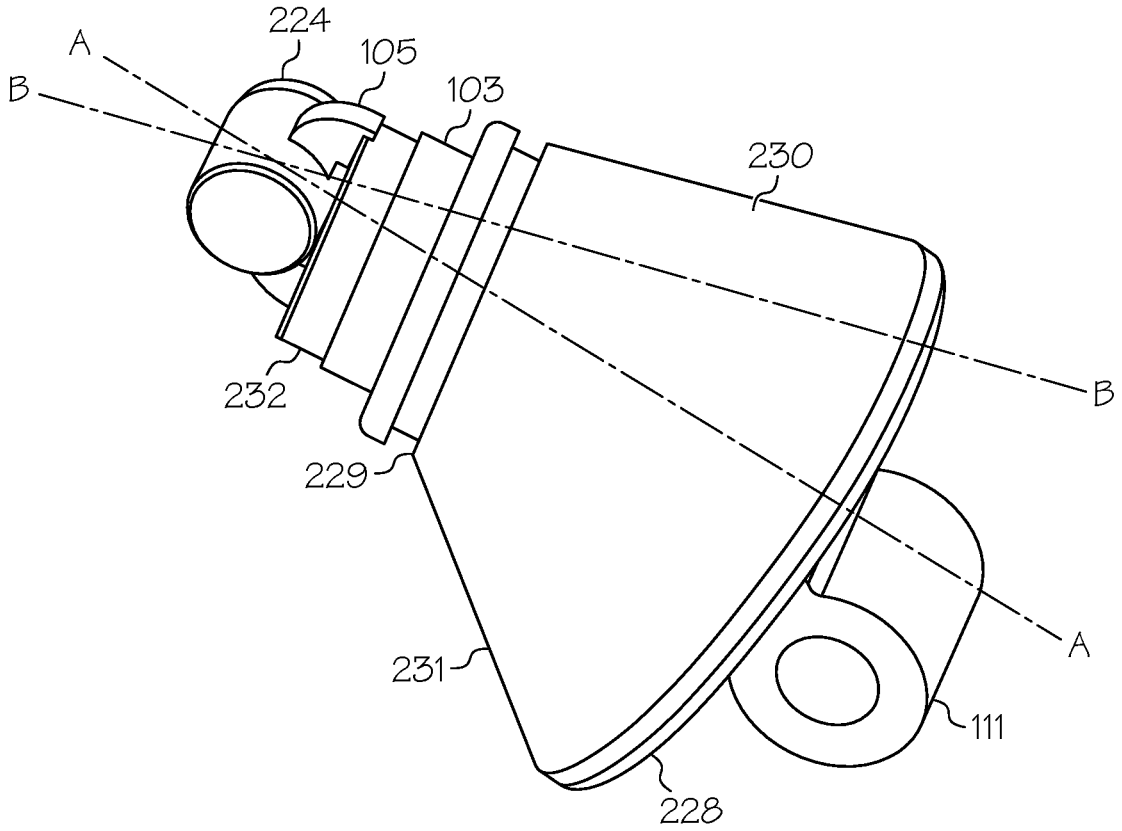
FIG. 3 is a perspective view of a portion of the in-ear headphone of FIGS. 1A, 1B, and 2, in accordance with some examples.

FIG. 1A is a perspective view of an in-ear headphone 10, in accordance with some examples. FIG. 1B is a cutaway view of the in-ear headphone 10 of FIG. 1A. FIG. 2 is an exploded view of the in-ear headphone 10 of FIGS. 1A and 1B. The headphone 10 can be an earbud or any other in-ear style earphone, which represents one type of headphone. However, the present concepts are not limited to the example of the in-ear headphone 10. Accordingly, other headphone types can equally apply. The headphone 10 is constructed and arranged for positioning in a left ear or a right ear. The headphone 10 is also constructed and arranged for noise reduction.

The earbud body 102 at least partially encases or surrounds a transducer 222, or acoustic driver or related sound-generating device, and or various mechanical and electrical components for performing functions of the headphone 10, for example, at or near a distal end of the body 102. To achieve this, the earbud body 102 includes an opening 227 at a nozzle of the body 102 and a cavity 226 formed in an interior of the body 102 by the presence of the transducer 222 inserted in the opening 227. The transducer 222 may include a diaphragm, voice coil, magnet, armature, electronics, and/or other elements for compressing and decompressing the air in front of the driver and in the cavity 226, thereby creating the sound waves conducted out of the body 102. A portion of the transducer 222 faces outward from the opening 227, for example, in a direction towards the eardrum when inserted in the ear canal. In particular, the transducer 222 has a sound radiating surface facing out from the opening 227, and has an opposite surface facing into the cavity 226, so that sound-related signals produced at the speaker can be output from the opening 227.

A microphone 224 may be positioned in front of the transducer 222, for example, as part of an active noise reduction feedback system. The microphone 224 may be positioned in or near the opening 227, or may be positioned in front of the opening 227 if the transducer fills the opening, placing the microphone at the end of the body 102 farthest into the ear canal, which we refer to as the "distal" end. A coupling element 105, for example, a rigid hoop or the like, may be positioned near a top region of the transducer, and the microphone 224 may be attached to the coupling element 105 for separating the microphone 224 from the transducer 222 by a predetermined distance.

The cavity 226 may be configured to have a conical, for example, frusto-conical, or parabolic shape for increased volume, desired for device performance. In some examples, the earbud body 102 has a conical shape, for example, frusto-conical, for a transition from a sealed back region 228 of the body 102 to the reduced diameter of the front region of the body 102 at which the transducer 222 and microphone 224 are positioned. The conical cavity 226 may maintain desirable sound pressure levels. In particular, the cone shape allows the transducer and microphone to be positioned farther into the ear canal, while still providing a reasonable back-cavity volume behind the transducer. However, the preferred volume may not fit in the ear, even with the cone-shaped body. In such a situation, adsorbent material may be used to reduce the required physical volume of the cavity 226 while still providing the desired effective acoustic volume, for example, described in U.S. Pat. No. 8,784,373 incorporated by reference herein in its entirety.

The stiff back enclosure section 228 can be coupled to, for example, bonded, glued, threaded, and so on, to the back region of the body 102. In other embodiments, the body 102 can be molded or otherwise formed where the back enclosure section 228 and the body 102 are unitary, e.g., molded of a single material as distinguished from separate physical elements coupled together that form the sealed back enclosure. Either construction provides an acoustic seal that permits the body 102 to acoustically isolate the cavity 226 from the environment external to the body 102, thereby providing some degree of noise reduction.

Figure 4:
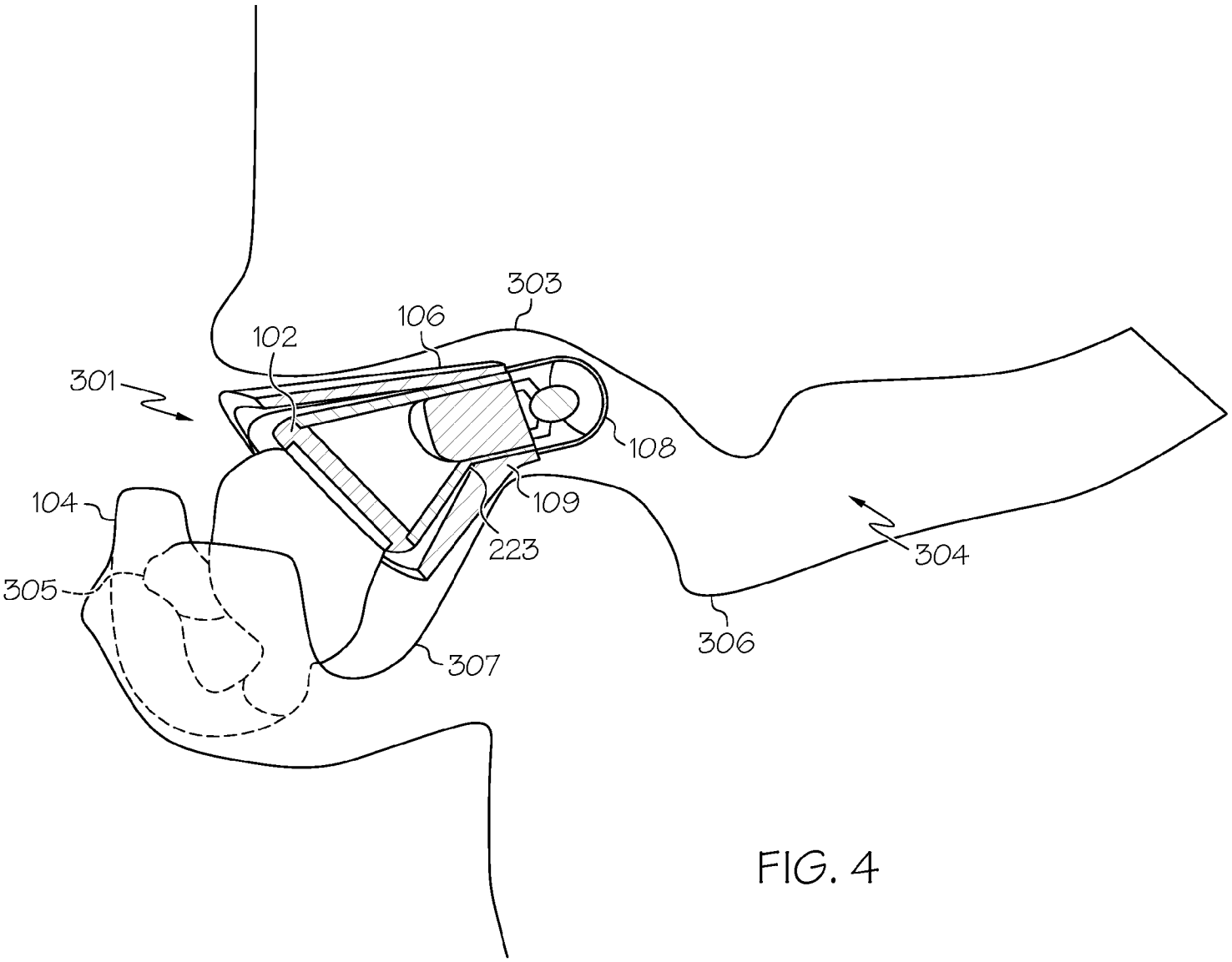
FIG. 4 is a cross-sectional view of in-ear headphone positioned in an ear, in accordance with some examples.

The body 102 can include a bend 223 for accommodating contours in the ear canal (see for example bends 303, 306 shown in FIG. 4). In some embodiments, the earbud body 102 can have a first side surface 230 that is linear or a continuous curve with the taper of the back portion of the body, and a second side surface 223 that is angled relative to the wall of the back portion of the body. In some embodiments, the earbud body 102 has a first portion 231 that is cone-shaped, i.e., a first end and a second end wider than the first end. The first portion 231 of the earbud body 102 may extend along a central axis A. The earbud body 102 may also have a second portion 232 at its distal end that extends along an axis B that is not parallel to the central axis A. A bend 223 is located where the second portion 232 extends from the first portion 231, and where the second portion 232 along axis B diverges from first portion 231 along axis A. Thus, the bend 223 can be positioned in a region of the ear canal having non-linear or irregular surfaces, e.g., contours, bends, etc., allowing the transducer and microphone to be positioned a bit farther into the ear canal than a straight assembly would allow.

A region of the earbud body 102 at the bend 223 has a cross sectional area of the body 102 that is smaller than the cross sectional area and other dimensions of the ear canal, since the location, the area and the angle of the bend 223 may vary from person to person. For example, as shown in FIG. 4, the first bend 303 in an ear canal 304 may be about 6-9 mm from the ear canal entrance 301 for a typical person.

Also, the seal formed by the earbud tip 106 against the ear canal surface may not be formed at the region of the bend 109, 223, but more likely to extend further back along the cone-shaped body of the tip 106. Referring to FIG. 4, the oval shape of the ear canal entrance may have an average dimension of 9 mm by 6.5 mm. A seal may be formed between the earbud tip 106 and the ear canal anywhere between the entrance 301 to the ear canal 304 and the first bend 303 in the ear canal 304, or farther along the ear canal 304 in a direction toward the eardrum, or wherever the actual dimensions of the particular ear canal become less than the largest dimension of the cone-shaped portion 231.

The interior of the body 102 comprising the cavity 226 and opening 227 may include an interior bend 229 (distinguished from bend 223 at the external surface of the body 102). The cavity 226 may be at the first portion 231, and the opening 227 to the cavity 226 at the second portion 232. The first portion 231 and the cavity 226 extend in a first direction of extension along axis A. The second portion 232 and the opening 227 to the cavity 226 diverge from the first direction of extension in a second direction of extension along axis B at an angle relative to the first direction of extension. The interior bend 229 between the cavity 226 and opening 227 may be at a region of the earbud body 102 between the first portion and the second portion where the second portion and the opening to the cavity 226 diverges from the first direction of extension, or axis A.

The retaining loop 104 is adapted for use with the in-ear headphone 10. The retaining loop 104 is structured and designed for positioning along the antihelix of the ear, and for retaining the ear bud body 102 in place at the ear canal. In some embodiments, the body 102 includes a coupling mechanism 111 that extends from the stiff back enclosure section 228. As shown in FIG. 1B, the retaining loop 104 can be removably coupled to the stiff back enclosure section 228 via the coupling mechanism 111.

An earbud tip 106 can be positioned over the body 102. The earbud tip 106 includes an outer sealing membrane that partially or completely surrounds the body 102. The earbud tip 106 is formed of a soft material that can stretch, or otherwise comply with the surface of the earbud body 102, and provides comfort during contact with the ear because of its softness. In embodiments, where the body 102 is generally cone-shaped and includes bend 223, the earbud tip 106 is also cone-shaped and includes a bend 109. The earbud tip 106 can include at least one tab 107 or the like that engages with a corresponding notch 103, threads, or the like in the wall of the body 102 to secure the earbud tip 106 against the body 102.

The earbud tip 106 can include a stiff mesh structure 108 located at the distal end of the earbud. The mesh structure 108 has the shape of a dome, in some cases the dome is located at the end of a short cylinder. The mesh structure 108 is constructed and arranged to cover the opening 227 of the earbud body 102. The hoop 105 that retains the microphone may further increase a stiffness of the dome of the mesh structure 108. The mesh structure 108 extends in the second direction of extension along axis B. The mesh structure 108 is a porous structure, and is formed of a material that has low no acoustical resistance. For example, the mesh structure 108 may be formed of a cloth that may or may not be metal, such as a wire mesh, or a low acoustical resistance fabric, and at least one structural layer, for example, sheet metal or a composite with holes, perforations, or the like. One example of a low-acoustical resistance fabric is that provided by Saati S.p.A.

FIG. 4 is a cross-sectional view of in-ear headphone 10 positioned in an ear, in accordance with some examples. As described above, a surface of the earbud body 102 includes a bend 223 for accommodating a bend in the ear canal 304. Earbud tip 106 can be positioned about the earbud body 102, and include a bend 109 conforming with earbud bend 223. The nozzle opening 227 is angled relative to the cone-shaped portion 231 of the earbud body 102 for extending into the entrance 301 to the ear canal 304, and into the ear canal 304. The proper positioning of the earbud body 102, and more specifically, the second portion 232 of the body 102 and the mesh structure 108 at the distal end of the earbud tip 106, may be achieved by positioning the loop 104 at the antitragus 305 of the ear for stable positioning between the first bend 303 and the concha cavity 307.

In some examples, the headphone 10 may include a pressure equalization tube (not shown) that extends through the surface of the distal end of the body 102 to balance the pressure in the ear canal 304 to the back cavity 226 so that the transducer 222 is not negatively impacted during earbud insertion/removal. Another pressure equalization tube may extend between the back cavity 226 and external environment so that the combination of the two tubes can balance the pressure from the ear canal to the back cavity 226 and to the external environment.

The shape and configuration of the earbud body 102 can provide improved frequency response and improved ANR performance, namely, by the bend 223 permitting the nozzle opening 227 having a different direction of extension than the cone-shaped portion 231 of the earbud body 102 to extend further into the ear canal 304 than a nozzle having an outer surface having a linear, single direction of extension. Also, the configuration of the nozzle tip 106 on the earbud body 102 may facilitate the formation of a seal between the body 102 and the surface of the ear canal 304.

As described above, the body 102 is constructed to comfortably couple the acoustic elements of the earphone 10 to the physical structure of the wearer's ear. As shown in FIG. 4, the body 102 is shaped to navigate the contours of the ear canal 304, but not apply significant pressure on the flesh of the ear canal 304. At the same time, the body 102 and earbud tip 106 may provide a seal to the ear canal 304 with minimal pressure, and thus provide little or no irritation to the ear.

The microphone 224 and transducer 222 extend from the rear cavity 226 and are positioned in the ear canal 304, for example, between first bend 303 and second bend 306. In doing so, these components are susceptible to particles which may damage them. The mesh structure 108 at the distal end of the earbud tip 106 prevents particles or other undesirable objects from reaching the microphone 224 and transducer 222. The screen fabric dome of the mesh structure 108 is provided to reduce irritation of the canal 304 in the event that the mesh structure 108 abuts a wall of the ear canal 304. In other embodiments, the mesh structure 108 is positioned in the ear canal 304 but does not contact the ear canal 304 after insertion in the ear. This fabric may also provide structural stiffness to the dome of the mesh structure 108.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. An in-ear headphone, comprising:

an earbud body constructed and arranged for positioning in an ear canal of a wearer, the earbud body configured to have a distal end farther into the ear canal than a proximal end;

a flexible earbud tip extending over and spaced apart from the earbud body, the flexible earbud tip being configured to form a seal between the earbud tip and at least a portion of the wearer's ear canal, wherein:

the earbud tip has a first portion and a second portion, the first portion of the earbud tip at the proximal end of the earbud body and extending in a first direction of extension, the second portion of the earbud tip at the distal end of the earbud body and diverging from the first direction of extension in a second direction of extension at an angle relative to the first direction of extension, and the earbud tip comprising a bend at a region of the earbud tip between the first portion of the earbud tip and the second portion of the earbud tip, wherein the bend is configured to accommodate a contour in the wearer's ear canal; and a retaining loop coupled to the earbud body and for positioning along an antihelix of the wearer's ear.

2. The in-ear headphone of claim 1, wherein the earbud body comprises a cavity having a first end and a second end wider than the first end, the first end comprising an opening to the cavity.

3. The in-ear headphone of claim 2, wherein the earbud body comprises a bend for accommodating a contour in the wearer's ear canal.

4. The in-ear headphone of claim 3, wherein the bend in the earbud tip is constructed and arranged for positioning over the bend in the earbud body.

5. The in-ear headphone of claim 3, wherein the earbud body has a first portion and a second portion, the cavity is at least at the first portion of the earbud body, the opening to the cavity is at the second portion of the earbud body, the first portion of the earbud body and the cavity extending in the first direction of extension, the second portion of the earbud body and the opening to the cavity extending in the second direction of extension at an angle relative to the first direction of extension.

6. The in-ear headphone of claim 5, wherein the bend in the earbud body is at a region of the earbud body between the first portion of the earbud body and the second portion of the earbud body, where the second portion of the earbud body and the opening to the cavity diverge from the first direction of extension.

7. The in-ear headphone of claim 2, further comprising a microphone at the opening to the cavity of the earbud body.

8. The in-ear headphone of claim 7, further comprising an acoustically resistive mesh structure covering the opening to the cavity, and positioned over the microphone.

9. The in-ear headphone of claim 2, wherein the second end of the cavity comprises a sealed back.

10. The in-ear headphone of claim 2, further comprising an electro-acoustic transducer in the cavity of the earbud body, the electro-acoustic transducer proximal to the microphone.

11. The in-ear headphone of claim 1, wherein at least a portion of the earbud body has a frusto-conical shape.

12. The in-ear headphone of claim 1, wherein the earbud tip comprises a coupling mechanism that engages with a coupling mechanism at the earbud body to secure the earbud tip to the earbud body.

13. An ear interface for an in-ear headphone comprising:

a flexible earbud tip extending over and spaced apart from an earbud body, the flexible earbud tip being configured to have a distal end farther into an ear canal of a wearer than a proximal end, and further configured to form a seal between the earbud tip and at least a portion of the wearer's ear canal, wherein the earbud tip has a first portion and a second portion, the first portion of the earbud tip at the proximal end and extending in a first direction of extension, the second portion of the earbud tip at the distal end and diverging from the first direction of extension in a second direction of extension at an angle relative to the first direction of extension, and the earbud tip comprising a bend at a region of the earbud tip between the first portion of the earbud tip and the second portion of the earbud tip, wherein the bend is configured to accommodate a contour in the wearer's ear canal; and a retaining loop for positioning along an antihelix of the wearer's ear.

14. The ear interface of claim 13, wherein the earbud tip is attached to and about at least a portion of an earbud body.

15. The ear interface of claim 14, wherein the earbud body comprises a cavity having a first end and a second end wider than the first end, the first end comprising an opening to the cavity.

16. The ear interface of claim 15, wherein the earbud body comprises a bend for accommodating a contour in the wearer's ear canal.

17. The ear interface of claim 16, wherein the bend in the earbud tip is constructed and arranged for positioning over the bend in the earbud body.

18. The ear interface of claim 16, wherein the earbud body has a first portion and a second portion, the cavity is at least at the first portion of the earbud body, the opening to the cavity is at the second portion of the earbud body, the first portion of the earbud body and the cavity extending in the first direction of extension, the second portion of the earbud body and the opening to the cavity extending in the second direction of extension at an angle relative to the first direction of extension.

19. The ear interface of claim 16, wherein the bend in the earbud body is at a region of the earbud body between the first portion of the earbud body and the second portion of the earbud body, where the second portion of the earbud body and the opening to the cavity diverge from the first direction of extension.

20. The ear interface of claim 13, wherein at least a portion of the earbud tip has a frusto-conical shape.

* * * * *